US005150884A

United States Patent [19]

Hyer et al.

[11] Patent Number: 5,150,884

[45] Date of Patent: Sep. 29, 1992

[54] CARPET STRETCHER ATTACHMENT UTILIZING PIVOTALLY MOUNTED PULLING PLATE

[76] Inventors: Raymond E. Hyer, 2194 Saragossa Ave., DeLand, Fla. 32724; Michael L. Hyer, 835 W. Gaucho Cir., Deltona, Fla. 32725

[21] Appl. No.: 562,612

[22] Filed: Aug. 3, 1990

[51] Int. Cl.[5] ..... B66D 1/00

[52] U.S. Cl. ..... 254/209

[58] Field of Search ..... 254/206, 207, 209, 210, 254/211, 212

[56] References Cited

U.S. PATENT DOCUMENTS

| | | | |
|---|---|---|---|
| 301,166 | 7/1884 | Sawyer et al. | 254/209 |
| 303,008 | 8/1884 | Hill, Jr. | 254/209 |
| 306,548 | 10/1884 | Taylor, II | 254/206 |
| 451,571 | 5/1891 | Patterson | 254/212 |
| 462,781 | 11/1891 | Tippy | 254/206 |
| 470,068 | 3/1892 | Mikesell | 254/210 |
| 549,044 | 10/1895 | Zander | 254/212 |
| 639,718 | 12/1899 | Dexter | 254/212 |
| 2,108,506 | 2/1938 | Owens | 254/212 |
| 3,001,762 | 9/1961 | Skolnick | 254/212 |
| 3,441,252 | 4/1969 | Koppelmans | 254/206 |
| 3,706,440 | 12/1972 | Ross | 254/212 |
| 3,752,440 | 8/1973 | Ream | 254/209 |
| 3,980,274 | 9/1976 | Ebert | 254/212 |
| 4,076,213 | 2/1978 | Payson | 254/210 |
| 4,230,302 | 10/1980 | Crain, Jr. | 254/212 |
| 4,538,846 | 9/1985 | Alexander | 254/212 X |
| 4,730,858 | 3/1988 | Humann | 254/209 X |

*Primary Examiner*—Katherine Matecki
*Attorney, Agent, or Firm*—Julian C. Renfro

[57] ABSTRACT

A portable carpet stretching device [in accordance with this invention enables] enabling a user to stretch carpeting at an angle into engagement with a tack strip affixed along the base of an adjacent wall, thus to eliminate wrinkles. This device comprises a carpet-engaging head member and a relatively fixed base member. The front of the base member is attached by an extensible member to the rear of the head member, and pivotally connected anchoring means are utilized for securing the base member in a desired relationship to the adjacent wall. Power applying means enable the user to force the head member and the base member apart, so the anchoring of the base member with respect to the adjacent wall by the anchoring means results at the time of application of the power means, in the portion of the carpet engaged by the head member being forced toward the adjacent wall and into contact with the tack strip. The anchoring means forming the principal subject matter of this invention comprises a pulling plate having a lower edge adapted to engage the tack strip. The upper edge of the pulling plate is pivotally connected to the base member, with this pivotal connection enabling the head member as well as the frame of the device to be moved into a non-symmetrical relationship to the pulling plate, whereby a pull at an angle to the adjacent wall and the tack strip can be applied to the carpet when the power applying means is operated.

11 Claims, 4 Drawing Sheets

FIG 5
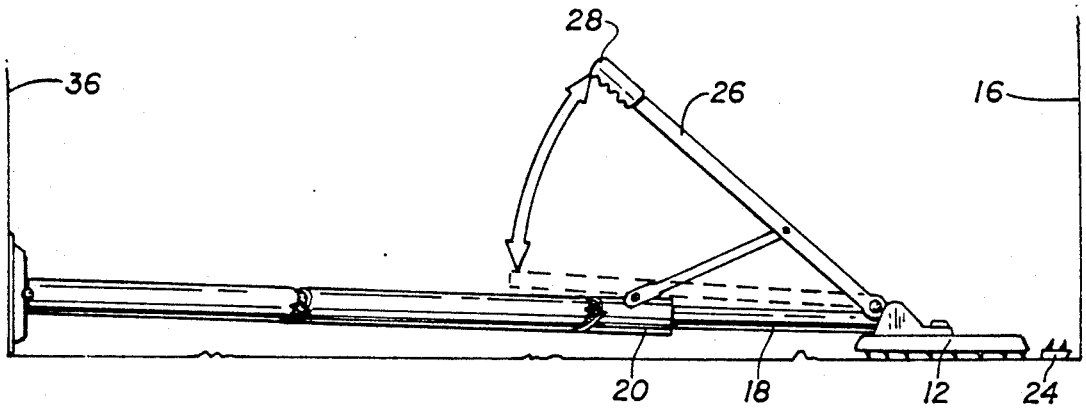
PRIOR ART
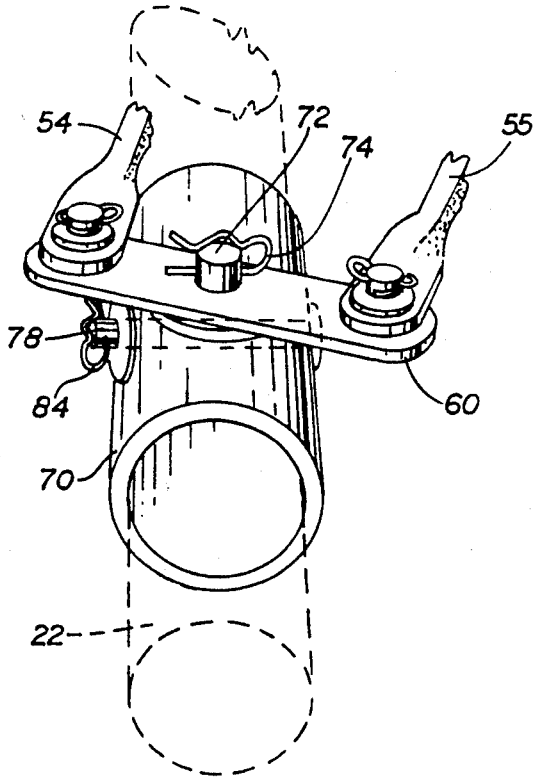
FIG 6

CARPET STRETCHER ATTACHMENT UTILIZING PIVOTALLY MOUNTED PULLING PLATE

BACKGROUND OF THE INVENTION

One form of carpet stretcher commonly used in the laying of carpets is a so-called power stretcher, which comprises a head with downwardly extending teeth to engage the carpet, a tailpiece and extensions through which pressure is applied to the opposite wall of the room to resist the restretching force, and manually operable power means interconnecting the head and the tailpiece to force the head away from the tailpiece, thus developing a force to pull the carpet toward the tack strip utilized near the baseboard of the near wall.

Since the distance between the location at which the pulling force is to be applied to the carpet and the opposite wall will always be varying, sectional extension poles or tubes are employed to transmit the pulling force from the tailpiece to the opposite wall. These are large and cumbersome, and must be carried to the job and subsequently removed. Even on a single job, the usual situation requires that the length of the poles or tubes be changed from time to time in order to accommodate the various pulling requirements. Furthermore, on some jobs there may be obstruction, e.g., a piece of furniture which it is not practical to move, making it difficult or impossible to position the poles so as to apply the pressure force from the tailpiece to the opposite wall. A "kicker" is often employed by a carpet layer, but it is not an adequate substitute for a power stretcher.

The present invention is an attachment for a conventional power stretcher to transmit the stretching force as a pulling force applied to the floor head of the stretcher. This is in contrast to the present practice of applying pressure to the wall at the rear of the stretcher. This invention has the advantages that: it is relatively low in cost, even as compared to the extension poles commonly employed; it is small and lightweight to move about and much less cumbersome than the extension poles; and it permits a highly effective form of power stretcher to be used at a location at which an extension pole to reach the opposite wall could not be employed.

We are aware of the teachings of the Ebert U.S. Pat. No. 3,980,274, wherein a blade is hooked against the side of the tack strip opposite to the area in which the carpeting is being laid, and a pressure member is placed at the rear of the tailpiece of the carpet stretcher. Ebert utilizes a frame that transmits the carpet stretching force from the pressure member to the blade and thus to the carpet strip immovably secured to the floor. Unfortunately, the Ebert device is a two piece device, such that the user must frequently reposition a pair of devices rather than a single, unitary device.

Even more importantly, the Ebert device can only bring about a pulling of the carpet directly toward the near wall, in a perpendicular relationship thereto, which is disadvantageous in that the pull of the carpet in an angular relationship to the near wall is often necessary in order to eliminate wrinkles.

We are also aware that an apparatus known as a power restretcher has been available to carpet layers and that this restretcher employs a blade which is hooked onto the tacking strip in a fashion similar to the blade of my attachment. However, these re-stretchers are a relatively complicated piece of equipment, certainly as compared to the attachment utilized by our invention. This means that the carpet layer has a substantial additional investment in a re-stretcher, along with the problem of getting it on the job and removing it when the job is done.

Some carpet installers utilize a so-called mini stretcher at such time as the edge of the carpet is to be brought up into close contact with the baseboard, with this device having a component that hooks over the tackstrip. Upon the installer manipulating the handle, the carpet tightening effect is brought about.

Unfortunately, the component that hooks over the tackstrip blocks the view of the part of the carpet being worked with, but even more importantly, the mini-stretcher causes a wrinkle to be formed in the carpet. It is thus usually necessary for a knee kicker to be used in order to complete the effort.

Significantly, our invention is not a carpet stretcher in and of itself, but rather may be regarded an attachment to the stretcher that the carpet layer already utilizes, with our attachment increasing the utility and versatility of that existing carpet stretcher at a modest cost.

SUMMARY OF THIS INVENTION

A portable carpet stretching device in accordance with this invention is utilized for stretching carpeting into engagement with a tack strip affixed along the base of an adjacent wall. Our device comprises a number of principal components, comprising a carpet-engaging head member having front and rear portions, and a relatively fixed base member having front and rear portions. The front of the base member is attached by an extensible member to the rear of the head member, and anchoring means are utilized for securing the base member in such a manner that its front portion is in a fixed relationship to the adjacent wall.

A handle is pivotally mounted to the rear portion of the head member, and is manually movable between raised and lowered positions. A link extends between the base member and a mid portion of the handle, and is pivotally connected to each. The handle, when moved from the raised to the lowered position, forces the head member and the base member apart, because of the intervention of the link. The anchoring of the base member with respect to the adjacent wall by the anchoring means we use results in the portion of said carpet engaged by the head member bring forced toward the adjacent wall and tightly into contact with the tack strip.

The anchoring means in accordance with this invention comprises a pulling plate having elongate upper and lower edges, with the lower edge of the pulling plate being adapted to engage the tack strip located along the base of the adjacent wall. A pair of elongate arms connect the upper edge of the pulling plate to the base member, with one end of each of the arms being pivotally connected adjacent one upper corner of the pulling plate, with the other end of each arm being pivotally connected to the rear portion of the base member.

Quite advantageously, the pivotal connections of the arms enables the installer, on occasion, to move the tail portion of of the device in a desired direction into a non-symmetrical relationship to the pulling plate, thus enabling the carpet installer to eliminate the wrinkles sure to appear if only pulls of the carpet perpendicular to the near wall were able to be made.

It is therefore a principal object of this invention to provide a carpet stretcher attachment of modest cost, which can greatly increase versatility while decreasing the bulk of the conventional power stretcher used by carpet installers.

It is another object of this invention to provide a carpet stretcher attachment of unitary and highly advantageous construction, that has an inherent flexibility making it possible for the carpet installer to cause the carpet to be pulled at an appropriate angle toward the wall nearest the point of use.

It is still another object of our invention to provide a device making unnecessary the employment of a series of tubes commonly used in connection with the conventional power stretcher, while still making it possible for the carpet installer to move the carpet as forcefully as necessary in a desired direction, including moving the carpet in an angular relationship to the near wall in a wrinkle-eliminating manner.

It is yet another object of our invention to provide a carpet stretching device of highly advantageous construction, that can either be manufactured as a complete, ready to go device immediately usable by the carpet installer, or as a device able to be readily retrofitted to an existing power stretcher, in order that the utilization of the series of tubes commonly used in connection with the conventional power stretcher can be regarded as entirely unnecessary.

These and other objects, features and advantages are to be made more apparent in connection with the appended figures of drawing.

BRIEF DESCRIPTION OF DRAWINGS

FIG. 5 is a device in the nature of a prior art power stretcher, which shows the near and far walls of the room, and the handle the carpet installer manipulates during the carpet installation procedure;

FIG. 6 is a view to a larger scale of the pivotally mounted member utilized on the tailpiece, which member forms the rear support for the pair of elongate arms that extend up to pivotal connections made at the upper corners of the pulling plate;

DETAILED DESCRIPTION

Figure 1:
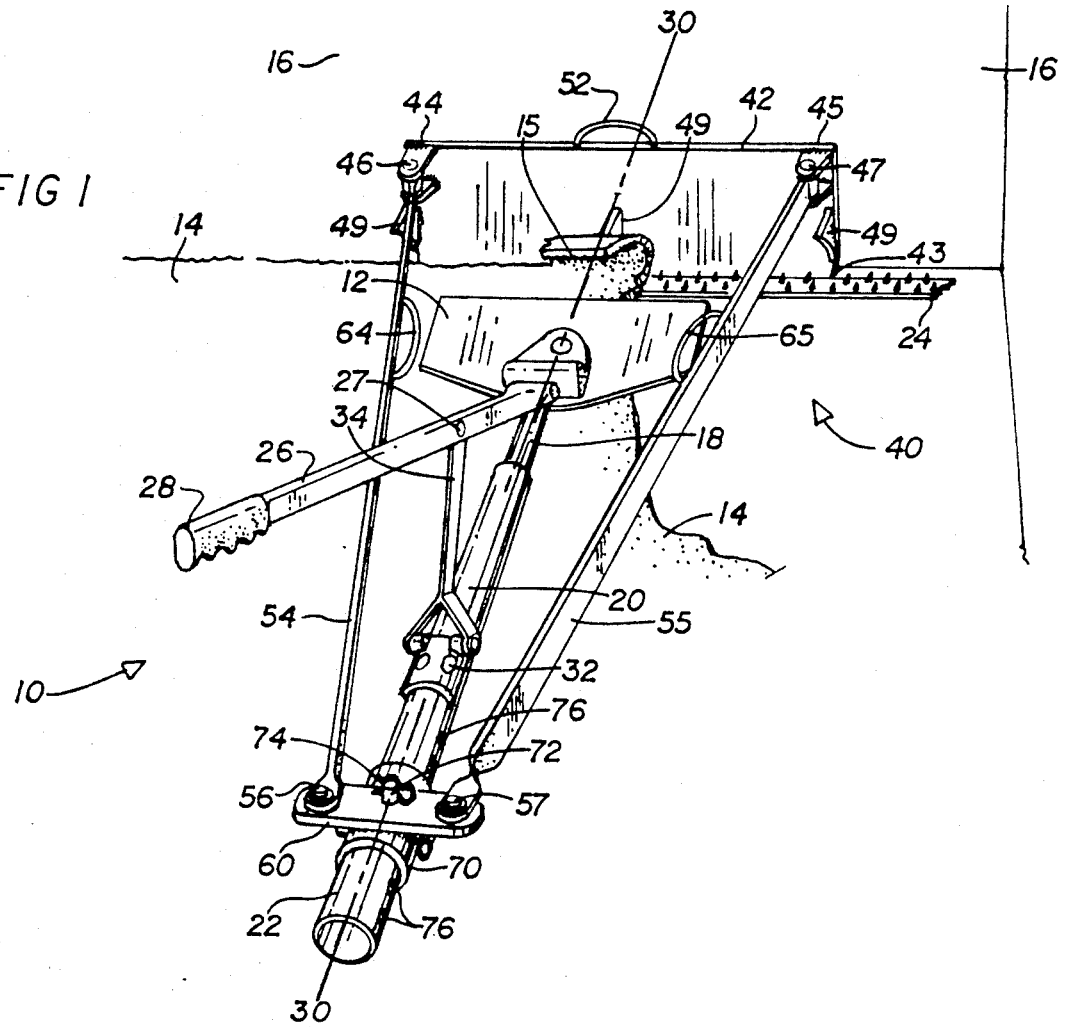
FIG. 1 is a perspective view of a preferred embodiment of a carpet stretching device in accordance with this invention, shown in relation to a tack strip laid along the base of the near wall, with the pulling plate utilized to engage the conventionally used tack strip being pivotally mounted by the use of a pair of elongate arms.

With initial reference to FIG. 1, it will there be seen that we have provided a carpet stretcher device 10 in accordance with this invention, including a head member 12 having a toothed undersurface adapted to engage the carpet 14 to be stretched toward what we call the near wall 16.

The rearmost end of the head member 12 is attached to the forwardmost portion of a tubular member 18, which slidably engages a relatively fixed tubular member 20, latter also being known as the base member. The base member or tubular member 20 is typically of a larger diameter than that of the tubular member 18, and because of the slidable relationship of these two tubularly shaped members, the distance between the head member 12 and the relatively fixed tubular member 20 can be readily changed during the installation of a carpet, as will be explained shortly.

In accordance with the so-called power stretchers of the prior art, into the tail piece 22 of the relatively fixed tubular member 20 is inserted one end of at least one fixed length extension tube or pole (not shown), with the far end of such extension tube being arranged to derive a fixed relationship on behalf of the tubular member 20, by the direct or indirect contact of the end of the extension tube with the far wall 36 of the room in which the carpet 14 is being installed. Note FIG. 5 in this regard, which figure is captioned "PRIOR ART."

It should be noted that in FIG. 1, we have shown a centerline 30 extending through the head member 12, and the tubularly configured base member 20, as well as through the pulling plate 42, described hereinafter. This centerline is of particular consequence to our invention, and will be discussed in connection with FIGS. 3 and 4.

For the purpose of explanation, let it be assumed that the far wall 36 depicted in FIG. 5 is parallel to the near wall 16, and some 10 to 25 feet away from the near wall 16.

It is frequently necessary, when using the power stretchers of the prior art, to utilize a plurality of fixed length, interfitting tubes in order that the tubular member 20 can attain a momentary fixed relationship to the near wall 16 of the room, toward which the edge 15 of the carpet 14 is being stretched. In order that this can be accomplished, an appropriate relationship of the tubular member 20 to the far wall 36 must be frequently established in order that the handle member 26, described hereinafter, can be manipulated by the carpet installer in order to force the carpet portion engaged at that time by the head member 12, toward the tack strip 24 that is located along the baseboard of the near wall 16.

The handle member 26 is pivotally affixed to the rearmost end of the head member 12, which handle member can be moved between raised and lowered positions, for a purpose soon to be explained. The end of the handle member 26 remote from the head member 12 is equipped with a suitable handgrip 28, and the typical motion of the handle is indicated by the double-headed arrow in FIG. 5.

Continuing to describe our invention with regard to its relationship with the carpet stretching devices of the prior art, it will be noted that attached to the upper surface of the relatively fixed tubular member 20 is an attachment point 32, to which is pivotally attached a sturdy link 34 of fixed length. The end of the link 34 opposite the attachment point 32 is pivotally attached to a midpoint 27 on the underside of the handle member 26. These components form a toggle type arrangement familiar to most persons acquainted with the carpet installation trade.

When the handle 26 is moved from the raised position to the lowered position, if the base member 20 has been properly anchored, this motion of the handle forces the head member 12, and the carpet engaged thereby, toward the near wall 16.

In accordance with the so-called power stretchers of the prior art, the tubular member 20 can achieve a fixed relationship to the previously mentioned remote wall 36 of the room, by the use of an appropriate number of interfitting tubes or poles, utilized in the manner illustrated in FIG. 5. When this has been accomplished, the carpet installer then pushes down upon the handgrip 28 of the handle member 26, which causes, by the intervention of the link 34, a forward motion of the front of the handle member 26, which in turn forces the head member 12 forward, toward the near wall 16.

Because of its toothed undersurface, this motion of the head member 12 in turn forces the edge 15 of the carpet 14 toward the near wall 16, so that the edge of the carpet nearest the wall can engage the sharp points on the tack strip 24 located adjacent the baseboard of the wall 16. It is expected that the carpet installer will use a hammer or the like to drive the underside of the carpet 14 into firm engagement with the upstanding points of the tack strip 24, after which the installer proceeds to cut away the excess portions of the carpet in a very precise manner by the use of a sharp blade.

At this particular setting of the tubular extension members used in accordance with the prior art, the carpet installer can move the carpet-engaging head member 12 to a number of adjacent locations on the carpet 14. By the teeth on the underside of the head member 12 engaging successive locations on the carpet, an entire area of the carpet 14 can be effectively moved toward the near wall 16. As is obvious, the carpet installer can move the array of interfitting tubes a bit in the appropriate lateral direction from time to time, so that the tube array will at all times be in contact with the most auspicious locations on the far wall 38. This will best enable the installer to continue the task of moving substantial portions of the edge 15 of the carpet 14 into a tight relationship with the tack strip 24 extending along the base of the near wall 16.

It should be briefly noted at this time that in most instances, the tube array lies essentially in a perpendicular relationship to the near wall 16, but in order to reduce wrinkling, the carpet installer may from time to time be utilizing the power stretcher in an angled relationship to the near wall 16. This point will be covered more fully hereinafter, with particular regard to FIG. 2 and others of the figures of drawing.

Thus far in the explanation of FIG. 1, very little is new, but we felt it necessary for a careful understanding of our invention, that the basic ingredients of a power stretcher of the prior art, as well as its function, be described. Roberts Consolidated Industries, Inc. of 600 North Baldwin Park Blvd, City of Industry, California 91749-1250 makes a power stretcher of the type depicted in FIG. 5, and we claim no inventorship in such a device per se. Certain portions of the apparatus depicted in FIG. 1 are new, however, as are about to be explained.

In FIG. 1 we reveal our novel carpet stretcher attachment device 40 in accordance with this invention, that is utilized in combination with the well known power stretcher components that include the head member 12, the relatively slidable member 18 that interfits with the tubularly shaped base member 20, and the handle and link members.

Our attachment device 40 principally involves the novel, pivotally mounted pulling plate 42 that is designed to be placed adjacent the tack strip 24 along the near wall 16, and the components associated with the pulling plate. The pulling plate 42 has a lower edge 43 designed to engage the tack strip 24, and an upper left corner 44 as well as an upper right corner 45. Elongate arms 54 and 55 are pivotally attached to the upper corners 44 and 45, respectively, of the pulling plate 42, and the construction and purpose of these components will be discussed shortly.

In accordance with common practice, a tack strip resembling the tack strip 24 illustrated in FIG. 1 is to be found nailed around the four sides of the room. Inasmuch as it is customary to drive nails through the tack strips and into the floor at approximately six inch intervals, we typically utilize a pulling plate 42 that is long enough to extend across at least two nails associated with the tack strip. Thus, we usually utilize a pulling plate 42 that is approximately fourteen inches wide, but we obviously are not to be limited to this. Not only does a pulling plate of this width span at least two nails used in connection with the tack strip, but also this width of pulling plate affords the carpet installer ample room to be dealing with the unsecured edge 15 of the carpet 14 during the carpet installation procedure.

Figure 9:
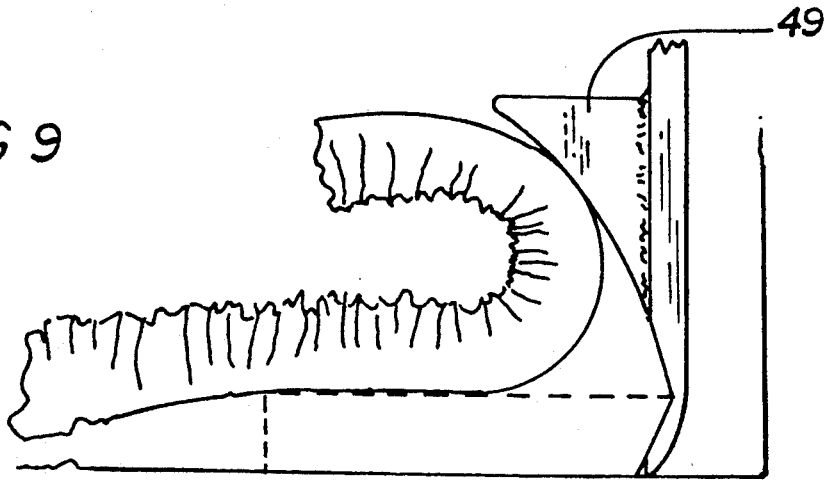
FIG. 9 is an enlarged view illustrating the use of one of the turning devices we prefer to utilize on an upper portion of the pulling plate.

As depicted in FIG. 1, it is typical for the free edge of the carpet to be folded back by the functioning of the turning members 49, located on the rear side of the pulling plate 42, which is the side toward the head member 12. Such turning members 49 are usually utilized at symmetrically placed locations on the pulling plate 42, and in FIG. 9 we reveal a typical turning plate to a large scale.

The ample access to the folded back portion of the carpet that is available to the user of our device is made possible by the substantial distance we utilize between the elongate arms 54 and 55 that are pivotally connected to the upper corners of the pulling plate 42. The wide spacing of the sturdy arm members affords the carpet installer excellent visibility of the work area, and makes it readily possible for him to press down upon the carpet in order to secure the underside of the carpet to the tack strip of the adjacent wall.

Figure 3:
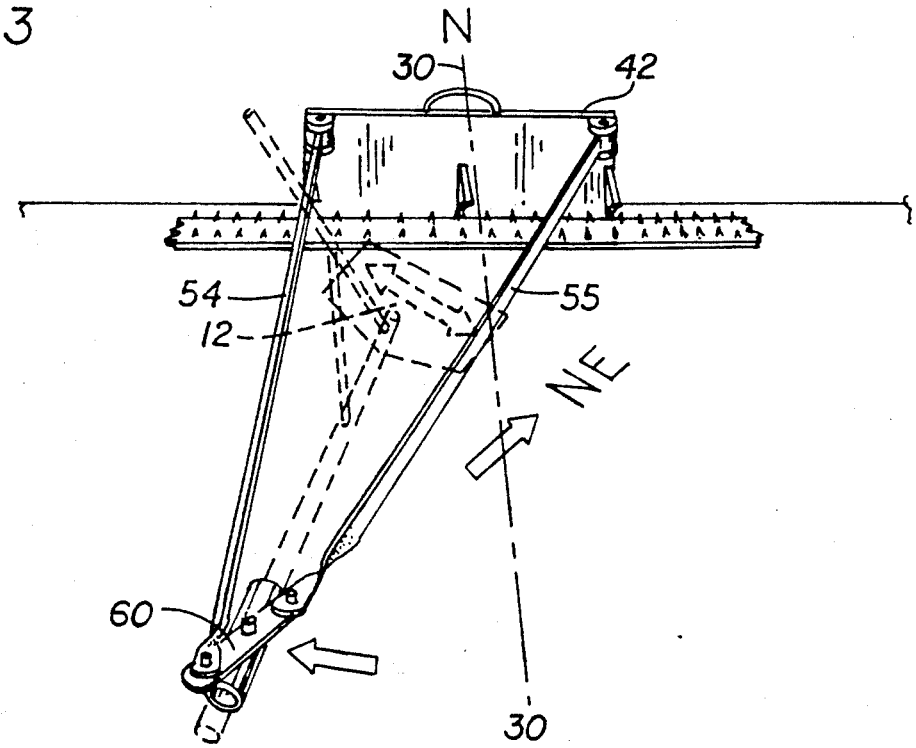
FIG. 3 is a somewhat simplified view illustrating the use of our device when the carpet installer has moved the tail portion of the device somewhat toward the left, and thus into an angular relationship to the near wall, in order to be able to move the carpet at an angle toward the wall during the procedure of eliminating wrinkles.
Figure 4:
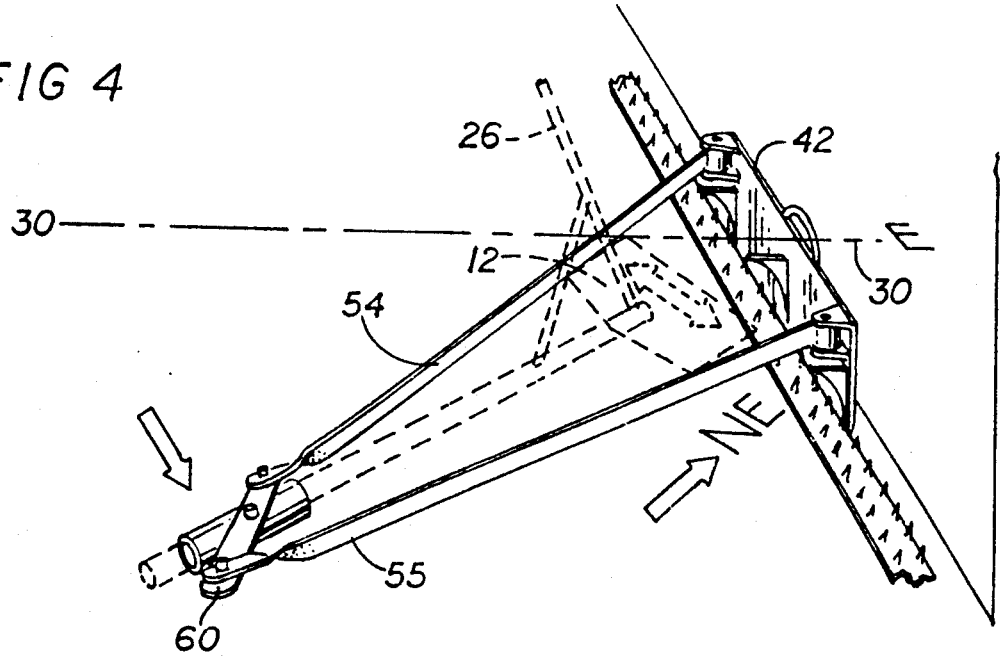
FIG. 4 is a somewhat simplified view illustrating the use of our device when the carpet installer has moved the tailpiece somewhat toward the right during the effort of moving the carpet toward the near wall, in a manner designed to eliminate wrinkles.

It will be noted from FIGS. 1, 3 and 4 that for the convenience of the carpet installer, we use a handle 52 atop the pulling plate 42, and also we use handles 64 and 65 on the upper surfaces of the arms 54 and 55. The handles 64 and 65 bear a particular relationship to the head member 12, as wi 11 hereinafter be described.

On the upper left and right corners 44 and 45 of the pulling plate 42 are attached the front ends of the elongate arm members 54 and 55, as seen in FIG. 1. It is important to note that we advantageously utilize a pivotal connection 46 at the upper left corner 44, and a pivotal connection 47 at the upper right corner 45 of the pulling plate 42, where the front portions of the arms 54 and 55, respectively, are attached to the pulling plate 42. The arm members 54 and 55 are of a structural nature, such as of steel, aluminum, or other such suitable material.

In accordance with this invention, the rear ends of the arms 54 and 55 are pivotally attached at 56 and 57 to a short, sturdy, pivotally mounted member 60, that is attached at a selected location on the tail piece 22 of the relatively fixed tubular member 20. We typically mount the short member 60 on a short tubular member 70 of a diameter large enough to be slid upon the tail piece 22, with an upward projection 72 welded or otherwise secured atop the member 70 forming the direct support for the member 60.

As is obvious from FIG. 6, by utilizing a cotter key 74, the member 60 can be prevented from undesired displacement from its pivotal mounting on the upward projection 72.

The power stretchers made by Roberts as well as other manufacturers normally have a spaced plurality of generally horizontally arrayed holes 76 located in the tail piece 22, such holes being indicated in FIG. 1. By the use of a pin 78 or the like, that is inserted in a selected hole 76, the carpet installer can readily secure the short tubular member 70 to an appropriate location on the tail piece 22, in that way to achieve a carpet installation device of unitary construction. A cotter key 84 prevents undesirable displacement of the pin 78 from the position shown in FIG. 6.

By virtue of our use of the pivotal connections on both ends of the sturdy arms 54 and 55, the relationship of the head member 12 with respect to the pulling plate 42 can in a highly advantageous manner be readily changed during a carpet installation procedure, but even more important, the tailpiece 22 can be easily swung away from the centerline 30 at such time as wrinkles are tending to develop in the carpet during the installation procedure. In this way the carpet installer can easily bring about the highly desirable angular pulls that will greatly simplify the task of eliminating wrinkles in the carpet during the procedure of bringing the edges of the carpet into proper contact with the respective tack strips.

Figure 7:
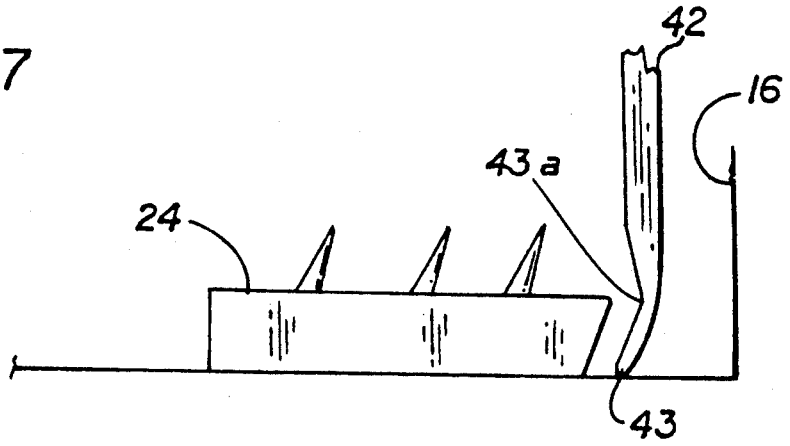
FIG. 7 is an enlarged view of a typical tack strip of wood, revealing how it is engaged by the lower edge of our pulling plate.
Figure 8:
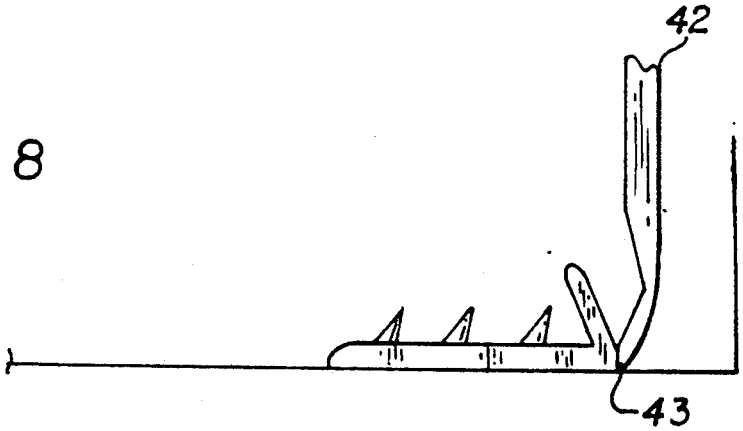
FIG. 8 is an enlarged view of a typical metal edging used where carpeting joins other types of floor covering, and revealing how the lowermost edge of the pulling plate can effectively engage same.

By the lower edge 43 of the pulling plate 42 engaging the tack strip 24, a firm, no-slip basis is established for the immobilization of the tubular member 20 with respect to the near wall 16, making unnecessary the use of the burdensome array of tubular members required in the utilization of the power stretchers of the prior art. We may prefer to use a notch or groove 43*a* running across the lower edge of the pulling plate, as shown in FIG. 7.

Figure 2:
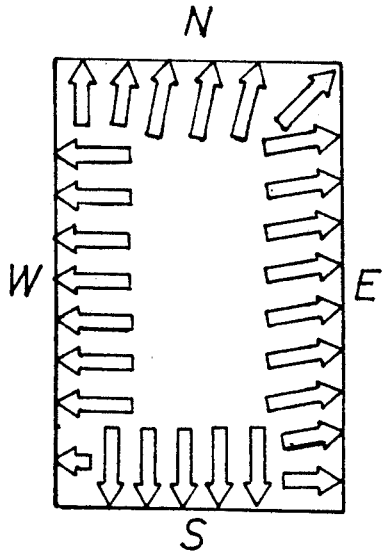
FIG. 2 is a diagrammatic showing, in which a series of arrows are utilized to represent the series of pulls typically made by a carpet installer in order to tightly install a carpet in a rectangular room, with the angularly placed arrows indicating specific angular pulls made during the installation of a carpet in order to eliminate wrinkles.

With particular reference now to FIG. 2, it will be seen that we there utilize a series of arrows to depict the pull directions that a carpet installer might well utilize in installing a carpet in a generally rectangularly configured room. In this figure we have assumed that the carpet installer has already secured one edge of the carpet to the tack strip located along the south wall S of the room, and another edge of the carpet to the tack strip located along the west wall W of the room.

Let it now be assumed that the carpet installer has also anchored one corner of the carpet to the western edge of the north wall of the room, and the diagonally opposite corner of the carpet to the southern edge of the east wall of the room.

It might normally have been expected that the carpet installer would be utilizing straight pulls of the northern edge and the eastern edge of the carpet, to move them into engagement with the north wall and the east wall, respectively of the room, thus to bring such carpet portions into contact with the respective tack strips.

In practice, however, it is necessary for the carpet installer, in this assumed situation, to move the northern edge of the carpet a bit in the easterly direction as well as in the northerly direction, as depicted by the arrows in FIG. 2, if wrinkling of the carpet is to be prevented. In a like manner, the carpet installer does not move the eastern edge of the carpet directly toward the east wall of the room, but rather he might well move the east edge of the carpet a bit toward the north and east, as depicted in FIG. 2, to prevent wrinkling of the carpet.

In the situation in which a power stretcher of the prior art is used, it would be expected that the carpet installer would logically also use a "knee kicker" of the type well known in the carpet installation art, in order to prevent wrinkling of the carpet.

A very important feature of our invention is the utilization of pivotal connections 46 and 47 by which the front ends of the arms 54 and 55 are secured to the backside of the pulling plate 42, and the pivotal connections 56 and 57 by which the rear ends of the arms 54 and 55 are secured to the short, pivotally mounted member 60. These connections make it possible for the type of pulls depicted in FIG. 2 to be readily carried out during a carpet installation procedure. If rigid connections had been utilized at the locations where the arms 54 and 55 are secured to the upper corners of the pulling plate, these highly advantageous angular pulls would not have been possible.

With reference now to FIGS. 2 and 3, when the carpet installer is working along what we have designated the northern edge of the carpet, he is concerned with pulling the carpet in a north-easterly direction, which is readily able to be accomplished in accordance with this invention, by causing the tail piece of the device to be moved to the left hand side of the centerline 30, as depicted in FIG. 3. While the pulling plate 42 remains in a parallel relation to the north wall, being affixed to the tack strip thereof, the head member 12 is in effect moved to a location more or less under the arm 55, so that when the handle member 26 is moved from the raised position to the lowered position, this will bring about movement of the northern edge of the carpet in the north-easterly direction, as depicted in FIG. 2. This arrangement thus makes it readily possible for the carpet to be stretched tightly and without wrinkles before being attached to the tack strip located along the north wall of the room. No knee kicker is necessary.

Similarly, and with reference to FIG. 4, it will be noted that when the carpet installer is installing the eastern edge of the carpet along the east wall, he will, in this assumed circumstance, move the tail piece 22 to the right of the centerline, to cause the carpet to be pulled in a north-easterly direction. By the pulling head 12 being located more or less under the arm 54 in this instance, the carpet is moved in a north-easterly direction at such time as the handle member 26 is moved from the raised to the lowered position.

It should thus be seen that in the utilization of our invention, we have been enabled to install a carpet in a tight and well fitting manner in a room without necessitating the use of either a power stretcher or a knee kicker as taught by the prior art. While the user of the Ebert device would not need to use a power stretcher of the type utilizing tubes as depicted in FIG. 5, such user would almost be forced to use a knee kicker in order to achieve proper tightness of the carpet, whereas in accordance with our invention, the pivotal connections we use at the ends of the arms 54 and 55 makes readily possible the combined movements depicted in FIGS. 3 and 4 of the drawings, with any use of a knee kicker being completely unnecessary.

In further distinction over the Ebert device, at such time as the short, pivotally mounted member 60 is secured to the tail piece 22, our novel arrangement becomes a unitary device, that in the assumed instance, the carpet installer can easily move from the north wall to the east wall, or vice versa, by the use of the effectively placed handle members 52, 64 and 65. The user of the Ebert device, by way of contrast, would typically move the original portion of the carpet stretcher to the new location, and as a separate matter, thereafter move the frame portion of the Ebert device to the new location. By this we refer to that which had been depicted in FIG. 1 of the Ebert U.S. Pat. No. 3,980,274.

The positioning of our fixed, curved handles 64 and 65 on the arms 54 and 55, as depicted in FIG. 1, is such that upon the handle 26 being lifted upwardly, to cause the head member 12 to be moved away from the carpet, the upper left and right sides of the head member come into contact with the undersides of the somewhat inwardly inturned handles 64 and 65. Contact of the head with these handles causes the arms 54 and 55 to also be lifted, along with the pulling plate 42. Thus, by lifting the handle 26 sufficiently high, the carpet installer has succeeded in easily lifting the entire attachment device constituting our invention.

It should now be apparent that we have provided a highly advantageous carpet stretching device of low to modest cost, of unitary and highly advantageous construction, that has an inherent flexibility making it possible for the carpet installer to cause the carpet to be pulled at an appropriate angle toward the wall nearest the point of use. Our device can be readily retrofitted to an existing power stretcher, making possible the elimination of the series of tubes ordinarily used by the carpet installer, or it can be manufactured and sold as a complete unit.

We claim:

1. A portable carpet stretching device for enabling a user to stretch carpeting at an angle into engagement with a tack strip affixed along the base of an adjacent wall, said device comprising a carpet-engaging head member and a base member, each of said members having front and rear portions, with the front of said base member being attached by an extensible member to the rear of said head member, and with said head member being closer to the adjacent wall then the base member, anchoring means for securing said base member with its front portion in a fixed relationship to the adjacent wall, power applying means for causing said head member and said base member to be forced apart, the anchoring of said base member with respect to the adjacent wall by said anchoring means resulting at the time of application of the power means, in the forcing of a portion of the carpet engaged by said head member toward the adjacent wall and into contact with the tack strip, said anchoring means comprising a pulling plate having elongate upper and lower edges, with the lower edge of said pulling plate including means for engaging the tack strip located along the base of the adjacent wall, and with the upper edge of said pulling plate being pivotally connected to said base member, by pivotal connecting means, said pivotal connecting means enabling said head member to be moved into a non-symmetrical relationship to said pulling plate, whereby a pull at an angle to the adjacent wall can be applied by said head member to the carpet when said power applying means is operated said pulling plate further comprising at least one turning member on the rear side thereof, to cause the free edge of the carpet being laid to be folded back at a desired angle.

2. The portable carpet stretching device for enabling a user to stretch carpeting at an angle as defined in claim 1, further comprising a notch on the lower side of said pulling plate, to enable said pulling plate to effectively engage a tack strip made of wood, and also able to effectively engage a metal edging used to separate carpet from another type of floor covering.

3. A portable carpet stretching device for enabling a user to stretch carpeting at an angle into engagement with a tack strip affixed along the base of an adjacent wall, said device comprising a carpet-engaging head member and a base member, each of said members having front and rear portions, with the front of said base member being attached by an extensible member to the rear of said head member, such that in a use position, said head member is closer to the adjacent wall than said base member, anchoring means for securing said base member with its front portion in a fixed relationship to the adjacent wall, power applying means for causing said head member and said base member to be forced apart, the anchoring of said base member with respect to the adjacent wall by said anchoring means resulting in a portion of the carpet engaged by said head member being forced toward the adjacent wall and into contact with the tack strip when said head member and said base member are forced apart by said power applying means, said anchoring means comprising a pulling plate having elongate upper and lower edges, with the lower edge of said pulling plate including means for engaging the tack strip located along the base of the adjacent wall, a pair of elongate arms connecting the upper edge of said pulling plate to said base member, with one end of each of said arms being pivotally connected adjacent one upper corner of said pulling plate and the other end of each arm being pivotally connected to the rear portion of said base member, this pivotal connection of said arms enabling said head member to be moved into a non-symmetrical relationship to said pulling plate, whereby a pull at an angle to the adjacent wall can be applied to the carpet by said head member when said power applying means is utilized.

4. The portable carpet stretching device for enabling a user to stretch carpeting at an angle as defined in claim 3 further comprising at least one turning member on the rear side of said pulling plate, to cause the free edge of the carpet being laid to be folded back at a desired angle.

5. The portable carpet stretching device for enabling a user to stretch carpeting at an angle as defined in claim 3, further comprising a notch on the lower side of said pulling plate, to enable said pulling plate to effectively engage a tack strip made of wood, and also able to effectively engage a metal edging used to separate carpet from another type of floor covering.

6. A portable carpet stretching device for stretching carpeting into engagement with a tack strip affixed along the base of an adjacent wall, said device comprising a carpet-engaging head member and a base member, each of said members having front and rear portions, with the front of said base member being attached by an extensible member to the rear of said head member, anchoring means for securing said base member with its front portion in a fixed relationship to the adjacent wall, power applying means for forcing said members apart, said power applying means comprising a handle pivotally mounted to the rear portion of said head member, and being manually movable between raised and lowered positions, a link extending between said base member and a mid-portion of said handle, and being pivotally connected to each, said handle, when forced from the raised to the lowered position, forcing said head member and said base member apart, because of the intervention of said link, the anchoring of said base member with respect to the adjacent wall by said anchoring means resulting in a portion of the carpet engaged by said head member being forced toward the adjacent wall and into contact with the tack strip, said anchoring means comprising a pulling plate having elongate upper and lower edges, with the lower edge of said pulling plate including means for engaging the tack strip located along the base of the adjacent wall, a pair of elongate arms connecting the upper edge of said pulling plate to said base member, with one end of each of said arms being connected by first pivotal connecting means adjacent one upper corner of said pulling plate and the other end of each arm being connected by second pivotal connecting means to the rear portion of said base member, said first and second pivotal connecting means enabling said head member to be moved into a non-symmetrical relationship to said pulling plate, whereby the carpet can be forced at an angle to the adjacent wall.

7. The portable carpet stretching device for enabling a user to stretch carpeting at an angle as defined in claim 6 further comprising at least one turning member on the rear side of said pulling plate, to cause the free edge of the carpet being laid to be folded back at a desired angle.

8. The portable carpet stretching device for enabling a user to stretch carpeting at an angle as defined in claim 6, further comprising a notch on the lower side of said pulling plate, to enable said pulling plate to effectively engage a tack strip made of wood, and also able to effectively engage a metal edging used to separate carpet from another type of floor covering.

9. A portable carpet stretching device for stretching carpeting into engagement with a tack strip affixed along the base of an adjacent wall, said device comprising a carpet-engaging head member having front and rear portions, a base member having front and rear portions, the front of said base member being attached by an extensible member to the rear of said head member, anchoring means for securing said base member with its front portion in a fixed relationship to the adjacent wall, a handle pivotally mounted to the rear portion of said head member, and being manually movable between raised and lowered positions, a link extending between said base member and a mid-portion of said handle, and being pivotally connected to each, said handle, when forcefully moved from the raised to the lowered position, forcing said head member and said base member apart, because of the intervention of said link, the anchoring of said base member with respect to the adjacent wall by said anchoring means resulting in a portion of the carpet engaged by said head member being forced toward the adjacent wall and into contact with the tack strip, said anchoring means comprising a pulling plate having elongate upper and lower edges, with the lower edge of said pulling plate including means for engaging the tack strip along the base of the adjacent wall, a pair of elongate arms connecting the upper edge of said pulling plate to said base member, one end of each of said arms being pivotally connected by first pivotal connecting means adjacent one upper corner of said pulling plate and the other end of each arm being pivotally connected by second pivotal connecting means to a mounting member which is pivotably and removably secured upon a rear portion of said base member, said first and second pivotal connecting means of said arms enabling said head member to be moved into a non-symmetrical relationship to said pulling plate, and thus move the carpet at an angle to the adjacent wall.

10. The portable carpet stretching device for enabling a user to stretch carpeting at an angle as defined in claim 9 further comprising at least one turning member on the rear side of said pulling plate, to cause the free edge of the carpet being laid to be folded back at a desired angle.

11. The portable carpet stretching device for enabling a user to stretch carpeting at an angle as defined in claim 9, further comprising a notch on the lower side of said pulling plate, to enable said pulling plate to effectively engage a tack strip made of wood, and also able to effectively engage a metal edging used to separate carpet from another type of floor covering.

* * * * *